US007340918B1

(12) United States Patent
Leban et al.

(10) Patent No.: US 7,340,918 B1
(45) Date of Patent: Mar. 11, 2008

(54) MAGNETOSTRICTIVE DRIVE OF REFRIGERATION SYSTEMS

(75) Inventors: Frank A. Leban, Columbia, MD (US); Joseph P. Teter, Darnestown, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 184 days.

(21) Appl. No.: 11/272,428

(22) Filed: Nov. 8, 2005

(51) Int. Cl.
*F25B 23/00* (2006.01)
*F25B 1/00* (2006.01)

(52) U.S. Cl. ..... 62/467; 62/498

(58) Field of Classification Search ..... 62/6, 62/115, 467, 498; 165/10; 137/487.5, 625.64; 417/322

See application file for complete search history.

(56) References Cited

U.S. PATENT DOCUMENTS 2,648,060 A * 8/1953 Turner, Jr. ..... 342/45
4,010,621 A * 3/1977 Raetz ..... 62/6
4,366,676 A * 1/1983 Wheatley et al. ..... 62/6
4,404,802 A * 9/1983 Beale ..... 60/520
4,726,741 A * 2/1988 Cusack ..... 417/322
5,022,229 A * 6/1991 Vitale ..... 62/6
5,303,555 A * 4/1994 Chrysler et al. ..... 62/6
5,875,764 A * 3/1999 Kappel et al. ..... 123/467
5,947,456 A * 9/1999 Aoki ..... 267/140.14
6,561,218 B2 * 5/2003 Mudd ..... 137/487.5
6,606,849 B1 * 8/2003 Salter et al. ..... 60/39.6

FOREIGN PATENT DOCUMENTS

WO WO 99/15281 * 1/1999

* cited by examiner

*Primary Examiner*—Mohammad M. Ali
(74) *Attorney, Agent, or Firm*—Jacob Shuster

(57) ABSTRACT

A liquid-phase cooling device of a refrigeration system has an outer tubular housing enclosing a heat exchanger through which a mixture gases and liquid constituting a working fluid media is heated and cooled while undergoing compression and expansion within a cavity formed in the outer tubular housing at an axial end portion thereof closed by an electromagnetic actuator under selective control of an electrical power source through which operation of the heat exchanger is effected. The actuator has a casing attached to the outer tubular housing of the heat exchanger at said axial end thereof within which a diaphragm attached to the axial end of the casing is exposed to the working fluid media within the cavity enclosed by the outer tubular housing of the heat exchanger. The diaphragm is engaged by a piston within the casing for axial deformation thereof to effect said compression and expansion of the fluid media under selective control of electrical current supplied from the power source to an electromagnetic coil through which a magnetic field is established within a body of magnetostrictive material disposed within the actuator casing between the piston and an end cap closing the axial end of the casing opposite the axial end to which the diaphragm is attached.

9 Claims, 2 Drawing Sheets

MAGNETOSTRICTIVE DRIVE OF REFRIGERATION SYSTEMS

The present invention relates generally to the powering of liquid phase cooling devices, associated with refrigeration systems, by use of magnetostrictive drive actuators.

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

Heretofore thermo-acoustic type of refrigeration systems involved an interplay between pressure, displacement and temperature oscillations of a fluid medium such as gas caused by sound waves derived for example from a moving acoustic coil arrangement. Such sound waves were also derived from solar, fuel combustion and accumulated waste heat sources. Acoustic coils associated with the thermo-acoustic refrigeration system involve use of a bobbin made of electrically conductive wire through which electrical current is conducted to forceably attach ferromagnetic material during operation of the refrigeration system.

Malone cycle types of refrigeration coolers as generally known in the art utilize a supercritical liquid as a working medium under a high pressure in place of gas. Such coolers are particularly attractive for submarine and sea vessels where space is at a premium. Also, Malone cycle coolers provide for greater power density per unit volume of the fluid cycling liquid, as compared to a Stirling gas refrigeration cycle during thermodynamic processing. In view of the high fluid operating pressure required for a Malone cycle cooler system, a robust mechanical design is necessary for efficient implementation thereof. Past implementation attempts involved use of a piston sleeve arrangement or a mechanically actuated diaphragm under cyclic system pressure, requiring most powerful actuation. It is therefore an important object of the present invention to provide sufficient operational power for efficient operation of refrigeration cooler systems.

SUMMARY OF THE INVENTION

In accordance with the present invention, operational power is provided either directly through mechanically imparted motion or indirectly by use of normally wasted energy to the liquid phase cooling devices of a refrigeration system, wherein liquid absorbs heat and transfers it to an external heat sink for dumping. Such cooling devices may be of a Malone cycle type or some other-type wherein thermal energy is converted into electrical energy for operation of the cooling device and storage in the heat sink.

BRIEF DESCRIPTION OF THE DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENTS

Figure 1:
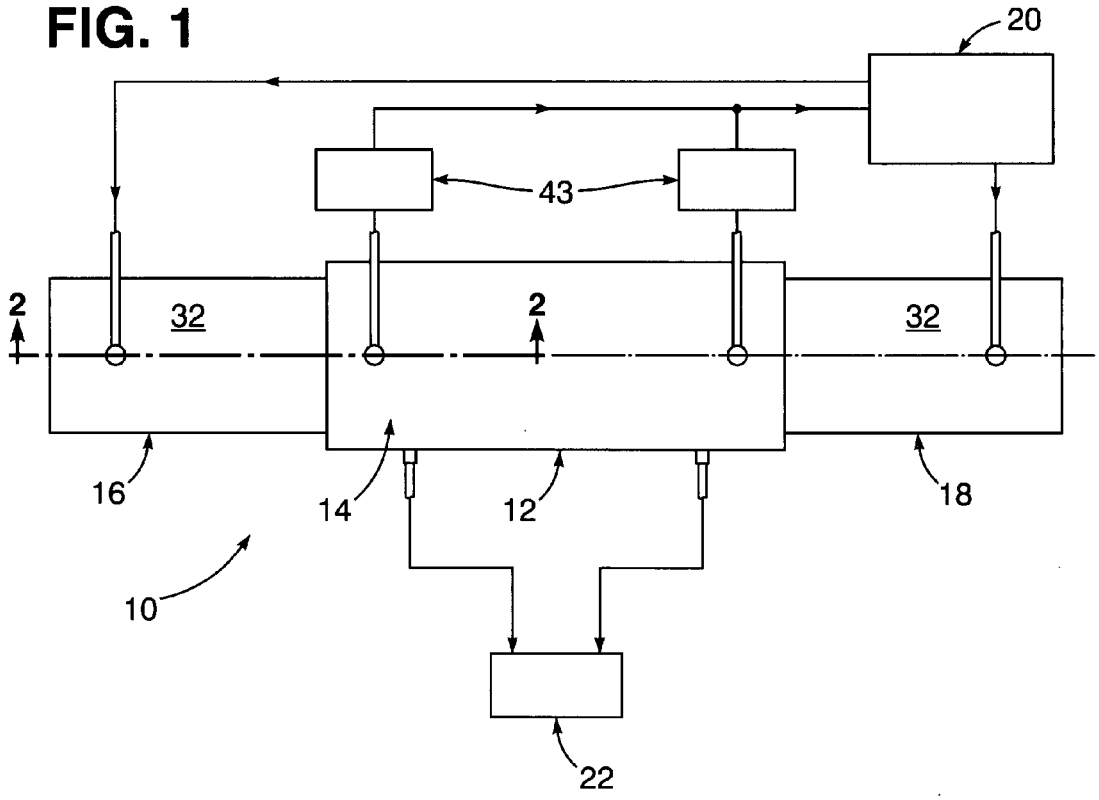
FIG. 1 is a side elevation view of an electrically powered refrigeration system of a liquid-phase Malone cycle cooler type with magnetostrictive actuators associated therewith.

Referring now to the drawings in detail, FIG. 1 illustrates one embodiment of the present invention, wherein an all-liquid phase Malone cycle type of refrigeration system 10 embodies a refrigerator 12 having an axially elongated outer tubular housing 14. A pair of magnetostrictive actuators 16 and 18 respectively extend axially into the tubular housing 14 at opposite axial ends thereof. As diagrammatically shown in FIG. 1, electrical energy for operation of the actuators 16 and 18 is supplied to the refrigerator 12 under selective control from a power source 20 for operation of the refrigeration system 10, while a fluid media is delivered to the refrigerator 12 from an external source 22.

Figure 2:
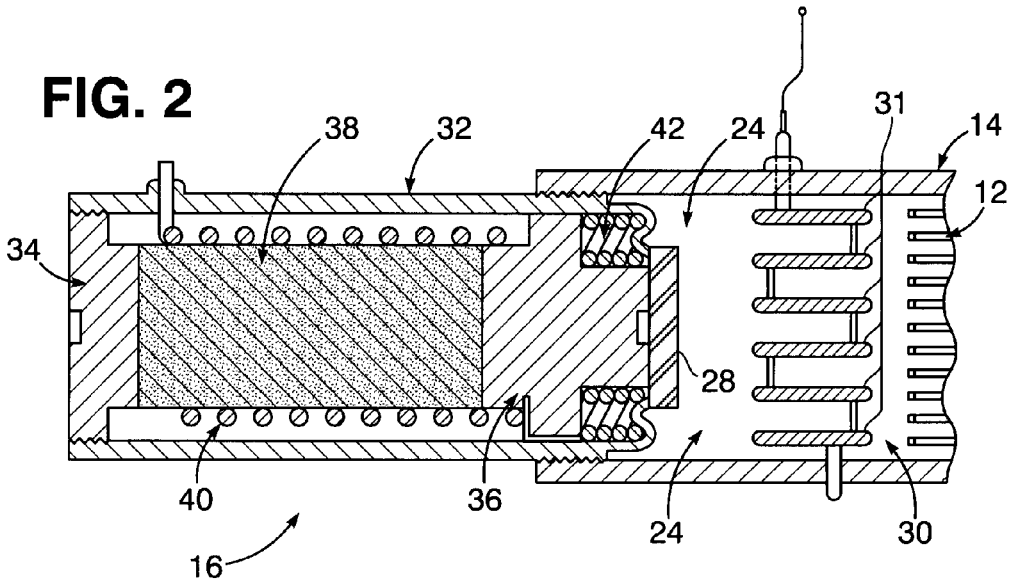
FIG. 2 is a partial side section view taken substantially through a plane indicated by section line 2-2 in FIG. 1.

Opposite axial end portions of the refrigerator housing 14 enclose cavities 24 which are sealed within the housing 14 by the actuators 16 and 18 as shown in FIGS. 1 and 2. The cavities 24 are filled with the fluid media under pressure received from the external source 22. Each of the actuators 16 and 18 within the tubular housing 14 at the opposite axial ends thereof has a flexible diaphragm 28 which are axially spaced by the cavities 24 from heat exchangers 30 associated with the refrigerator 12 as shown in FIG. 2. Such heat exchangers 30 have electrically powered heating elements 31 through which the temperature of the fluid media within the cavities 24 is controlled.

With continued reference to FIG. 2, each of the actuators 16 and 18 has a tubular casing 32 to which the flexible diaphragms 28 are attached within the refrigerator housing 14. A piston 36 is positioned within each of the actuator housings 32 in abutment with one of the diaphragms 28. Also disposed within each of the actuator casings 32, between the piston 36 and an end cap 34 threadedly attached to and closing the casing 32 at its axial end opposite the diaphragm 28, is a body of magnetostrictive material 38 which is subjected to a magnetic field established by an electromagnetic coil 40 to which electrical current is supplied from the power source 20 as diagrammed in FIG. 1. Also disposed within each of the actuator casings 32 at the axial ends to which the diaphragms 28 are attached as shown in FIG. 2, are springs 42 which exert prestress axial forces on the pistons 36 in one axial direction for compression or expansion of the fluid media filling the cavities 24 by deformation of the diaphragms 28 under selective control of the electrical current supplied to the coil 40 through switches 43 connected to the heating elements 31 associated with the heat exchangers 30 as diagrammed in FIG. 1.

By virtue of the foregoing described arrangement of the refrigeration system 10, it is operated by supply of electrical energy from the power source 20 at resonance frequency with reduced loading, allowing for an exact mechanical impedance match between mechanical power input motions imparted by the actuators 16 and 18 through the pistons 36 and the diaphragms 28 to the refrigerator 12 for compression and/or expansion of the liquid working fluid media within the cavities 24 and for heat transport cooling thereof through one of the heat exchangers 30 at one axial end of the refrigerator 12 to which the actuator 16 is attached, while heating is performed through the other heat exchanger 30 at the other axial end of the refrigerator 12 to which the actuator 18 is attached.

The working fluid media within the Malone cycle type of the refrigerator 12 as hereinbefore described is a supercritical fluid embodying highly compressed gasses such as carbon dioxide and liquids having properties which simultaneously provide for enhanced operation of the refrigeration system 10 with replacement of the sterling gas heretofore utilized in thermodynamic pump refrigerators.

Figure 3:
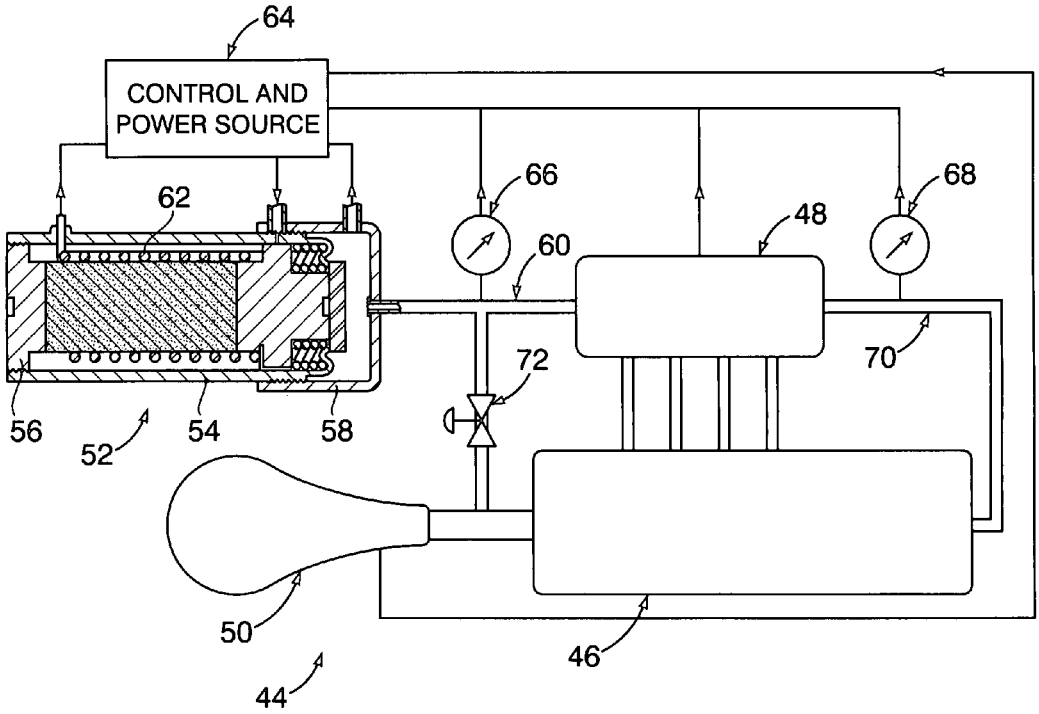
FIG. 3 is a side elevation view of another type of electrically powered refrigeration system with which the present invention is associated.

According to another embodiment of the present invention as shown in FIG. 3, a magnetostrictively driven pump and all liquid phase thermo-acoustic cover type of refrigeration system 44 replaces the Malone cycle type of refrigeration system 10 hereinbefore described. The refrigeration system 44 has a pulse tube 46 connected to a regenerator 48 and a resonator 50. Heat transport cooling is effected in response to mechanical power input to the regenerator 48 through a magnetostrictive actuator 52 which is similar to the actuators 16 and 18 hereinbefore described. An outer tubular casing 54 associated with the actuator 52 is closed at one axial end by an end cap 56, while the other axial end of the actuator casing 54 is threadedly attached to a tubular output motion transmitter 58 connected to the refrigerator 48 by an input 60 through which the mechanical input energy is applied thereto by the actuator 52. A selectively controlled power source 64 supplies electrical energy to the electromagnetic coil 62 in the actuator 52 for operation thereof. Mechanical motion sensors 66 and 68 are respectively connected to the refrigerator input 60 and to its output 70 connecting it to the pulse tube 46. Control over the resonator 50 connected to the pulse tube 46 is effected by mechanical output signals emitted from the pulse tube 46 for application to the power control 64 through a control valve 72 located between the resonator 50 and the refrigerator input 60.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a refrigeration system having a heat exchanger and a fluid media disposed therein, electrical powering means operatively connected to the heat exchanger for selectively controlled heating of the fluid media; and actuator means operatively connected to said electrical powering means for selectively controlled compression and expansion of the fluid media said actuator means including: a casing; a body of magnetostrictive material enclosed within said casing; electromagnetic coil means operatively connected to the electrical powering means for establishment of a magnetic field within the casing to which the body of magnetostrictive material is exposed; a diaphragm attached to the casing; and piston means within the casing between the diaphragm and said body of magnetostrictive material for selectively controlled deformation of the diaphragm to thereby effect said compression and expansion of the fluid media within the refrigeration system.

2. The combination as defined in claim 1, wherein said actuator further includes: spring means positioned within the casing for biasing the diaphragm in a direction tending to effect said compression of the fluid media.

3. The combination as defined in claim 2, wherein said heat exchanger of the refrigeration system includes: an outer tubular housing to which the casing of the actuator means is attached to enclose therein a cavity filled with the fluid media.

4. The combination as defined in claim 3, wherein said fluid media is a mixture of gases and liquids which simultaneously provide properties enhancing operation of the refrigeration system.

5. The combination as defined in claim 4, wherein said refrigeration system is of a Malone cycle type to which actuator means is attached at opposite axial ends of the outer tubular housing; and switching means for selectively activating the actuator means at one of said opposite axial ends of the tubular housing by said establishment of the magnetic field therein to effect either said compression or said expansion of the working fluid media.

6. The combination as defined in claim 1, wherein said refrigeration system is of a Malone cycle type to which said actuator means is attached; and switching means for selectively activating the electromagnetic coil means associated with the actuator means through which said magnetic field is established to effect either said compression or said expansion of the fluid media.

7. The combination as defined in claim 1, wherein said actuator means further includes: motion transmitter means attached to the casing for transferring energy from the electrical powering means to the heat exchanger thereby effecting said compression and expansion of the working fluid media.

8. The combination as defined in claim 1, wherein said heat exchanger of the refrigeration system includes: an outer tubular housing to which the casing of the actuator is attached to enclose therein a cavity filled with the fluid media.

9. The combination as defined in claim 1, wherein said fluid media is a mixture of gases and liquids which simultaneously provide properties enhancing operation of the refrigeration system.

* * * * *